US008726940B2

(12) United States Patent
Cohen

(10) Patent No.: US 8,726,940 B2
(45) Date of Patent: May 20, 2014

(54) FUEL EQUALIZATION SYSTEM

(75) Inventor: Kenneth W. Cohen, Fort Lee, NJ (US)

(73) Assignee: Westcast, Inc., Westfield, MA (US)

( * ) Notice: Subject to any disclaimer, the term of this patent is extended or adjusted under 35 U.S.C. 154(b) by 490 days.

(21) Appl. No.: 12/706,294

(22) Filed: Feb. 16, 2010

(65) Prior Publication Data

US 2010/0143853 A1 Jun. 10, 2010

Related U.S. Application Data

(63) Continuation-in-part of application No. 11/432,001, filed on May 11, 2006, now abandoned.

(60) Provisional application No. 61/680,805, filed on May 13, 2005.

(51) Int. Cl.

| | |
|---|---|
| ***B01F 5/04*** | (2006.01) |
| ***F03B 1/00*** | (2006.01) |
| ***F04D 29/44*** | (2006.01) |

(52) U.S. Cl.

USPC ..... 137/896; 415/208.1; 415/206; 415/191; 415/204

(58) Field of Classification Search

USPC ..... 137/896, 602; 415/208.1, 183, 185, 415/208.2, 203, 204, 208, 206, 151, 191

See application file for complete search history.

(56) References Cited

U.S. PATENT DOCUMENTS

| | | | | | |
|---|---|---|---|---|---|
| 909,863 | A | * | 1/1909 | Bowie | 415/204 |
| 2,101,916 | A | * | 12/1937 | Phail | 415/97 |
| 2,233,991 | A | * | 3/1941 | Walters | 415/97 |
| 2,287,822 | A | * | 6/1942 | Odor et al. | 415/185 |
| 2,290,423 | A | * | 7/1942 | Funk | 415/151 |
| 2,446,879 | A | * | 8/1948 | Kennedy | 415/211.2 |
| 2,452,274 | A | * | 10/1948 | Walters | 415/97 |
| 2,727,680 | A | * | 12/1955 | Madison et al. | 415/191 |
| 2,845,905 | A | | 8/1958 | Smith | |
| 3,019,963 | A | * | 2/1962 | Eck | 415/204 |
| 3,085,741 | A | * | 4/1963 | Burkhardt | 415/204 |
| 3,191,851 | A | * | 6/1965 | Wood | 415/119 |
| 4,344,479 | A | | 8/1982 | Bailey | |
| 4,466,641 | A | | 8/1984 | Heilman et al. | |
| 4,503,684 | A | * | 3/1985 | Mount et al. | 62/115 |
| 4,564,227 | A | | 1/1986 | Murck | |
| 4,573,869 | A | * | 3/1986 | Kitamoto | 415/211.1 |
| 4,579,375 | A | | 4/1986 | Fischer et al. | |
| 4,646,637 | A | | 3/1987 | Cloots | |
| 4,995,648 | A | | 2/1991 | Jackson | |
| 5,283,944 | A | | 2/1994 | Goodhue | |
| 5,321,880 | A | | 6/1994 | Goodhue | |
| 5,342,100 | A | | 8/1994 | Goodhue | |
| 5,358,013 | A | | 10/1994 | McClain | |
| 5,558,493 | A | * | 9/1996 | Hayashi et al. | 415/208.1 |
| 5,890,458 | A | | 4/1999 | Kim | |

(Continued)

*Primary Examiner* — Elizabeth Houston
*Assistant Examiner* — David Colon Morales
(74) *Attorney, Agent, or Firm* — McCormick Paulding & Huber LLP

(57) ABSTRACT

A fuel equalization system includes a filter box for accepting an air stream and a fuel stream, the air stream and the fuel stream mixing to form a mixed air/fuel stream. A blower is provided that has an inlet for accepting the mixed air/fuel stream from the filter box. An air deflection member is positioned in the path of the mixed air/fuel stream, between the filter box and the inlet, so as to reduce the turbulence of the mixed air/fuel stream.

10 Claims, 3 Drawing Sheets

(56) References Cited

U.S. PATENT DOCUMENTS 5,926,937 A 7/1999 Goodhue
6,092,988 A * 7/2000 Botros ..... 415/191
6,109,665 A 8/2000 Meinig
6,299,409 B1 * 10/2001 Matsunaga et al. ..... 415/206
6,412,519 B1 7/2002 Goodhue
6,547,287 B1 4/2003 Shah et al.
6,684,823 B1 2/2004 Plavnik et al.
7,036,462 B2 5/2006 Cohen

* cited by examiner

FUEL EQUALIZATION SYSTEM

CROSS REFERENCE TO RELATED APPLICATIONS

This application is a Continuation-in-Part of U.S. Utility patent application Ser. No. 11/432,001 filed on May 11, 2006 and claims the benefit of U.S. Provisional Application Ser. No. 60/ 680,805, filed on May 13, 2005, both of which are incorporated herein by reference in their entireties.

FIELD OF INVENTION

The present invention generally relates to forced air/fuel burner apparatus, and more particularly relates to a fuel equalization system that continues to supply a proper air/fuel ratio to such apparatus even during times of decreased or blocked air flow at a blower outlet.

BACKGROUND OF THE INVENTION

Burners are utilized in many integrated systems, such as in boilers, furnaces and water heater applications. These burners are typically fed an enriched air stream containing a predetermined concentration of fuel mixed therein. Of great importance, therefore, is the ability of the system to maintain a proper air/fuel mixture during operation of the system.

Typically, a filter box includes one or more orifices to accept incoming air and fuel streams, which are mixed within the box by motion of the air through the box. The filter box may include various baffles, blades, and other structures to enhance mixing of the air and fuel. A blower is operatively connected to the filter box, and propels the air/fuel mixture from the filter box, to an integrated burner. Any blockage of the incoming air or fuel streams, or of the flue leading to the burner, will cause a change in the air/fuel mixture being fed to the burner, with a corresponding potential for the harmful buildup of CO.

Known systems oftentimes employ one or more sensors within the filter box coupled with a variable speed blower to regulate the introduction of the air/fuel mixture to the burner. While these systems operate reasonably well during normal times, they suffer under blocked-flue or blocked-air inlet conditions due to the swirling air currents created by these adverse conditions. That is, known systems arrange the air/fuel inlet orifice(s) and sensors adjacent to, or near, the blower inlet, therefore the turbulence created at the air inlet by a blockage creates an 'implied' flow in and around the sensors. Thus, during times of blockages, the sensors of known systems are incapable of accurately controlling the desired air/fuel mixture, due to the swirling and turbulent implied flows washing over the sensors.

Known systems are therefore unable to accurately control the air/fuel mixture during times when the air inlet, or flue, is partially or completely blocked.

With the foregoing problems and concerns in mind, it is the general object of the present invention to provide a fuel equalization system that can accurately detect and respond to situations of air blockage so as to maintain safe air/fuel mixtures.

SUMMARY OF THE INVENTION

It is one object of the present invention to provide a fuel equalization system.

It is another object of the present invention to provide a fuel equalization system, which is capable of maintaining a desired air/fuel ratio.

It is another object of the present invention to provide a fuel equalization system which is capable of maintaining a desired air/fuel ratio even during times of blocked air flow.

It is another object of the present invention to provide a fuel equalization system which reduces the turbulence of a blocked air flow.

A further object of the invention is to position the air and fuel inlet orifices some distance from the blower inlet, thereby isolating the air and fuel inlet orifices from excessive turbulence caused by any blockages.

A further object of the invention is to decrease the number of clips that are engaged about the respective connected adjacent flange portions to prevent leakage.

A further object of the invention is to provide a fuel equalization system which substantially eliminates the creation of harmful gas build-up during times of partially or completely blocked air flows.

In accordance, therefore, with one embodiment, it is an object of the present invention to provide a fuel equalization system that includes a filter box for accepting an air stream and a fuel stream, the air stream and the fuel stream mixing within the filter box to form a mixed air/fuel stream; a blower that has an inlet for accepting the mixed air/fuel stream from the filter box and an outlet for forcing the air/fuel mixture to a burner; and at least one air deflection member positioned in the path of the mixed air/fuel stream, between the filter box and the blower inlet, so as to reduce the turbulence of the mixed air/fuel stream.

These and other objectives of the present invention, and their preferred embodiments, shall become clear by consideration of the specification, claims and drawings taken as a whole.

DETAILED DESCRIPTION OF THE PREFERRED EMBODIMENTS

Figure 1:
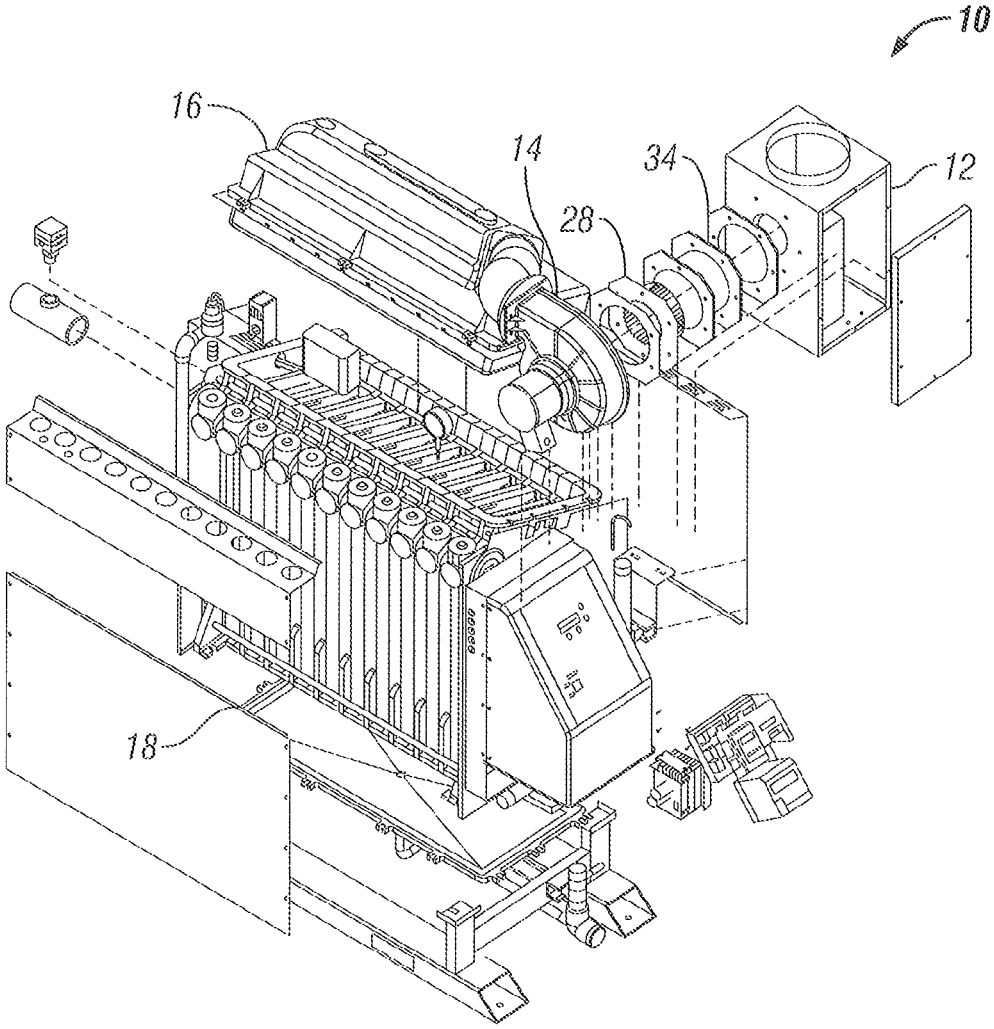
FIG. 1 illustrates an exploded view of a fuel equalization system according to one embodiment of the present invention.

FIG. 1 illustrates an exploded view of a fuel equalization system 10, according to one embodiment of the present invention. As shown in FIG. 1, the fuel equalization system 10 includes a filter box 12 and a blower 14. The blower 14 sucks an air/fuel mixture from the filter box and forces the air/fuel mixture to a burner assembly 16, which is operatively connected to a boiler apparatus 18.

It will be readily appreciated that while the boiler apparatus 18 has been described in connection with FIG. 1, the present invention is not so limited in this regard as the blower 14 may be connected to any suitable apparatus without departing from the broader aspects of the present invention.

Figure 2:
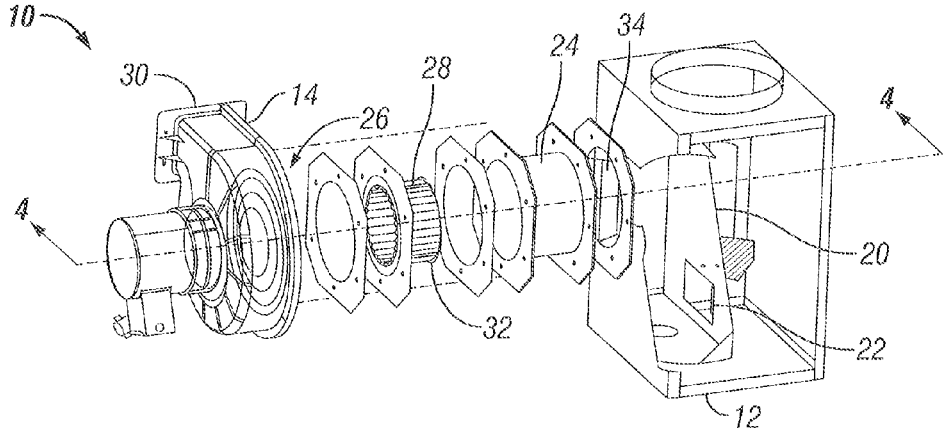
FIG. 2 is a partially exploded view of the fuel equalization system of FIG. 1, in isolation.

FIG. 2 illustrates the fuel equalization system in isolation. As shown in FIG. 2, the filter box 12 defines an inner box 20 having an air orifice and a fuel entry 22. A duct section 24 connects an outlet of the filter box 12 to the inlet of the blower 14. An air stream and a fuel stream are respectively directed through the air orifice and the fuel entry 22 via known means, are mixed together in the inner box 20, and this mixture is then sucked through the duct section 24 by the blower 14, which blows the mixture into the burner assembly 16.

It is an important aspect of the present invention that the air orifice and fuel entry 22 are not positioned adjacent to the blower inlet 26, as is typically known in the art. Instead, the present invention arranges the air orifice and fuel entry 22 as far away as possible from the blower inlet 26, thereby isolating the air orifice and fuel entry 22, and any associated sensors, from the turbulence that may be caused by any air/fuel stream blockage at the blower outlet.

A static impeller 28 is arranged within the duct section or spool piece 24 and adjacent the blower inlet 26. As shown, the impeller 28 is slightly smaller in outer diameter than the inner diameter of the enclosing spool piece. When the outlet 30 of the centrifugal blower 14 is partially or completely blocked, the resultant swirling air/fuel stream 'backs up' along the axis of the blower and is redirected back through the impeller 28 and through the duct section 24. The vanes 32 of the impeller 28 effectively reduce or eliminate the velocity and rotation of the redirected air/fuel stream passing therethrough.

The velocity and rotation of the re-directed air/fuel stream is further reduced or eliminated by the inclusion of a straightening blade 34, also formed in the duct section 24. As shown in FIG. 2, the straightening blade 34 is a generally flat piece of metal or plastic, and is preferably arranged along a diameter of the duct section 24. The straightening blade 34 acts as a baffle to intercept and further restrain the swirling air/fuel stream, prior to the redirected air/fuel stream entering the filter box 12.

It is therefore another important aspect of the present invention that the static impeller 28 and the straightening blade 34 effectively reduce or eliminate any implied air flow into the filter box. That is, the static impeller 28 and the straightening blade 34 reduce the velocity and swirling nature of the air/fuel stream that is redirected back through the duct section 24. When coupled with positioning of the air orifice and fuel entry 22 a distance away from the blower inlet 26, the static impeller 28 and the straightening blade 34 effectively isolate the air orifice and fuel entry 22 from the implied air flow that is generated by the blockage of the blower outlet 30. Thus, any sensors mounted adjacent the air orifice and fuel entry 22 do not suffer from imprecise readings, and the fuel equalization system 10 can therefore be operated even in conditions of nearly complete blockage of the blower outlet 30, or the like.

While the straightening blade 34 in FIGS. 1 and 2 is shown as being oriented substantially vertically, and extending substantially the entire diameter and length of the duct section 24, the present invention is not limited in this regard. Indeed, the straightening blade 34 need not extend vertically, or across the entire diameter of the duct section or along the entire length of the duct section 24, nor does the straightening blade 34 need to extend precisely along a diameter of the duct section 24, in order to substantially reduce or eliminate the velocity and swirling nature of the redirected, or implied, air/fuel stream.

Figure 3:
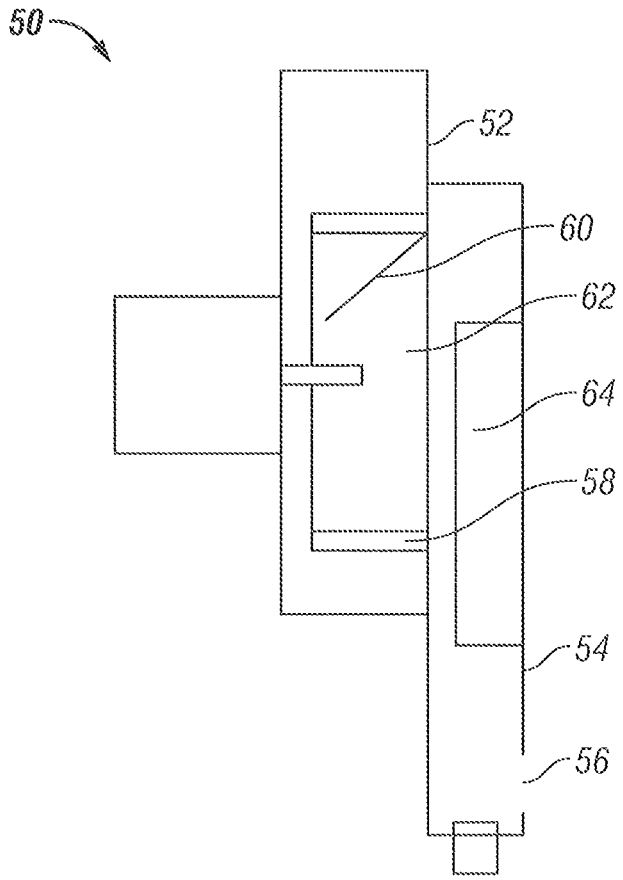
FIG. 3 illustrates a schematic side view of a fuel equalization system according to another embodiment of the present invention.

The embodiment shown and described in connection with FIGS. 1 and 2 has depicted a centrifugal blower 14, however the present invention is not limited in this regard. FIG. 3 illustrates a schematic side view of a fuel equalization system 50 according to another embodiment of the present invention. As shown in FIG. 3, the fuel equalization system 50 includes a squirrel cage blower 52 operably connected to a filter box 54. An air orifice and fuel entry 56 is formed in the filter box 54 and provides the fuel equalization system 50 with the required air/fuel stream in a well-known manner.

Also shown in FIG. 3 is a squirrel cage impeller 58, which is specially equipped with an air deflector plate 60. The deflector plate 60 is preferably arranged within the throat of the impeller 58 and is shaped to capture the majority of the redirected air/fuel flow, created by a blockage of the unillustrated blower outlet, or the like, back into the blower 52. For example, the deflector plate 60 can be shaped as a truncated cone opened at both ends. In this manner, any swirling, high velocity and redirected air/fuel stream created by a blockage of the blower outlet is largely kept within the blower 52, and consequently does not adversely affect the air orifice and fuel entry 56, or any related sensors disposed within the filter box 54.

The embodiment shown in FIG. 3 also arranges the air orifice and fuel entry 56 as far away from the blower inlet 62 as possible, similar to the embodiment of FIGS. 1 and 2, so as to further isolate the air orifice and fuel entry 56 from the effects of any implied air flow.

Figure 4:
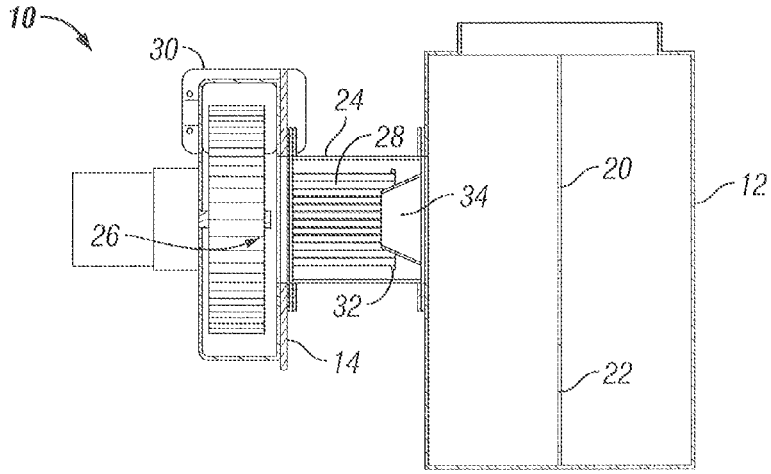
FIG. 4 is a sectional assembled partial view of the fuel equalization system shown in FIGS. 1 and 2, taken along the section line 4-4 shown in FIG. 2.

A straightening blade, or baffle, 64 is located in the filter box 54 in much the same manner that the straightening blade 34 is arranged in the embodiments of FIGS. 1 and 2. That is, the straightening blade 64 is located so as to substantially bisect the incoming redirected air/fuel stream, thereby reducing its velocity and swirling nature. Alternatively, as shown in FIG. 4, the straightening blade 64 can extend into the impeller 28 or 58, which is rotatable with reference to the structure supporting the straightening blade.

Although the embodiments of FIGS. 1-4 have illustrated the present invention as it is implemented in connection with a centrifugal blower system, and a squirrel cage blower system, the present invention is not so limited in this regard. Indeed, regardless of the type of blower that is employed, or the nature of the apparatus to which the blower provides the air/fuel mixture, the present invention envisions disposing a straightening blade/baffle within the path of any redirected air/fuel stream. The baffle itself may have a number of possible configurations and dimensions, provided that it extends along the path of any redirected air/fuel stream so as to reduce the velocity of the redirected air/fuel stream, as well as reducing the swirling nature of the redirected air/fuel stream.

The use of the static impeller 28, or the air deflector plate 60, in combination with locating the air orifice and fuel entry 56 as far as possible from the blower inlet 26/62, also assists in reducing the velocity of the redirected air/fuel stream, as well as reducing the swirling nature of the redirected air/fuel stream.

Thus, the present invention substantially eliminates the erroneous sensor readings and possible CO contamination stemming from a blocked blower outlet, or the like. By removing the effects of the implied air flow from the present fuel equalization system, the present invention is capable of properly regulating the air/fuel mixture that is provided to a blower and burner assembly, up to and including properly regulating the air/fuel mixture even during times of near complete blockage of the blower outlet or burner flue.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A fuel equalization system, comprising:

a filter box for accepting an air stream and a fuel stream, said air stream and said fuel stream mixing to form a mixed air/fuel stream;

a blower;

a vaned impeller in fluid communication with said blower and having an inlet for accepting said mixed air/fuel stream from said filter box prior to said mixed air/fuel stream being presented to said blower; and a substantially planar baffle disposed across the inlet of said impeller in the path of said mixed air/fuel stream, said baffle being fixed in position and extending through said inlet and into said impeller, wherein said baffle permits an unobstructed and simultaneous flow of said mixed air/fuel stream on opposing sides of said baffle; and wherein vanes of said vaned impeller and said baffle are configured to reduce the velocity and rotation of any redirected air/fuel stream passing therethrough.

2. The fuel equalization system of claim 1, wherein:

said baffle substantially bisects said impeller.

3. The system according to claim 1, wherein said impeller is movable together with said blower.

4. The system according to claim 1, wherein said impeller is fixedly connected to said duct section.

5. A method of reducing turbulence within a mixed air/fuel stream being provided to a blower, said method comprising:

arranging a filter box to be in fluid communication with said blower;

providing said filter box with said mixed air/fuel stream;

channeling said mixed air/fuel stream along a path from said filter box to said blower;

arranging an inlet opening in said blower to accept said mixed air/fuel stream;

forming a duct between said filter box and said inlet so as to define said path;

positioning a vaned impeller in a portion of said duct such that air returned from said blower through said inlet opening passes between the vanes of said impeller;

fixedly positioning a substantially planar baffle within said duct so as to retard the velocity and swirling nature of said mixed air/fuel stream; and extending said baffle into said portion of said duct and said impellers;

wherein said vanes and said baffle reduce the velocity and rotation of said returned air in said duct.

6. The method according to claim 5, said method further comprising:

positioning said impeller adjacent said inlet opening.

7. A fuel equalization system, comprising:

a filter box for accepting an air stream and a fuel stream, said air stream and said fuel stream mixing to form a mixed air/fuel stream;

a blower;

a duct section having an outlet in fluid communication with an intake of said blower and having an inlet for accepting said mixed air/fuel stream from said filter box prior to said mixed air/fuel stream being presented to said blower;

a vaned impeller disposed within said duct section so as to receive air returned from said blower into said duct section; and a substantially planar baffle extending along and substantially diametrically across the path of said mixed air/fuel stream, said baffle being fixedly positioned within said duct section and extending from the inlet of said duct section into said impeller, wherein said baffle permits an unobstructed and simultaneous flow of said mixed air/fuel stream on opposing sides of said baffle; and wherein vanes of said vaned impeller and said baffle are configured to reduce the velocity and rotation of said returned air passing through said duct section.

8. The fuel equalization system recited by claim 7, wherein:

said baffle substantially bisects said impeller.

9. The system according to claim 7, wherein said impeller is movable together with said blower.

10. The system according to claim 7, wherein said impeller is fixedly connected to said duct section.

* * * * *